US006565056B2

(12) United States Patent
Lin

(10) Patent No.: US 6,565,056 B2
(45) Date of Patent: May 20, 2003

(54) AXIAL URGING MECHANISM

(76) Inventor: Chin-Chih Lin, 3F, No. 128, Cha-Zhuang 1st Street, Kuei Shan, Taoyuan Hsien (TW)

( * ) Notice: Subject to any disclaimer, the term of this patent is extended or adjusted under 35 U.S.C. 154(b) by 0 days.

(21) Appl. No.: 09/955,054

(22) Filed: Sep. 19, 2001

(65) Prior Publication Data

US 2003/0042379 A1 Mar. 6, 2003

(30) Foreign Application Priority Data

Aug. 28, 2001 (TW) ..... 90214703 U

(51) Int. Cl.[7] ..... E04G 3/00

(52) U.S. Cl. ..... 248/284.1; 248/292.13; 248/918; 108/138

(58) Field of Search ..... 108/138, 50.02, 108/92, 94–96; 312/208.1, 223.3; 248/918, 292.13, 291.1, 284.1

(56) References Cited

U.S. PATENT DOCUMENTS 4,644,875 A * 2/1987 Watt ..... 108/138
5,037,054 A * 8/1991 McConnell ..... 248/284.1
5,351,891 A * 10/1994 Martin ..... 248/918
5,487,525 A * 1/1996 Drabczyk et al. ..... 108/138
5,791,263 A * 8/1998 Watt et al. ..... 108/138
5,823,487 A * 10/1998 Kirchhoff et al. ..... 108/93
6,270,047 B1 * 8/2001 Hudson ..... 108/7
6,296,215 B1 * 10/2001 McCoy et al. ..... 248/118.3

* cited by examiner

*Primary Examiner*—Korie Chan
(74) *Attorney, Agent, or Firm*—Troxell Law Office PLLC

(57) ABSTRACT

An axial urging mechanism includes a support device, a connecting seat, a pivotal shaft, and a pressing device. The support device provides two opposite lateral walls with connecting ends. The connecting seat has two opposite wing ends disposed between and adjacent to the connecting ends. The pivotal shaft passes through the connecting ends and the wing ends and provides a limit device at the inner wall surface of the respective wing end to press against the inner wall surface. The pivotal shaft has a thread screw section with a positive sense and a reversed sense at two ends thereof respectively. The pressing device includes two follower levers, each follower lever having a lever base with a thread screw hole engaging with the respective thread screw section and the inner wall surface of the respective follower lever is attached to the respective connecting end of the support device. The lever part extending upward from the lever base connecting with an end of a connecting rod and another end of the connecting rod connects with a bearing bush, and the bearing bush being attached to the respective connecting end of the support device.

13 Claims, 5 Drawing Sheets

AXIAL URGING MECHANISM

BACKGROUND OF THE INVENTION

1. Field of the Invention

The present invention relates to an axial urging mechanism, and particularly to an urging mechanism, which can be operated and controlled by way of a hand to actuate a pressing device disposed at both ends of a pivotal shaft so as to urge or release a support device and a connecting seat between the two pressing devices synchronously for locating or adjusting both the support device and the connecting seat.

2. Description of Related Art

Often in our daily life, we encounter a mechanical structure formed of two articles with a respective connecting end being passed through with a pivotal shaft to generate a relative movement between the articles. An arrangement with regard to two articles moving relative to each other generally can be classified into three different types, that is, a fixed type, a moving type, and an adjustment type. The fixed type structure utilizes a conventional joint such as a welding joint to maintain both articles in a state of being fixedly located after the connecting ends of the two articles are passed through with the pivot shaft. The moving type structure applies another conventional joint such as a rivet joint to allow both articles to move relative to each other after the connecting ends of the two articles are passed through with the pivot shaft. The adjustment type structure uses a further conventional way such as a thread screw connection to fasten or loosen both of the articles so as to locate the articles or make an adjustment after the connecting ends of the two articles are passed through with the pivot shaft. Accordingly, a joint for two connecting articles can be presented with different structures based on different applications.

Taking a keyboard stand as. an example, the basis of a design for the keyboard stand has included a concept of an omni-bearing in recent years, that is, in addition to the most basic functions such as pushing forward and pulling backward, the keyboard stand can provide further functions such as going up and down, displacing to the right and to the left, and adjusting the elevation angle. Indeed, this design has brought a great convenience to the user. For instance, U.S. Pat. Nos. 5,839,984, and 6,186,460B1 owned by the present inventor have disclosed an axial urging device respectively and these urging devices basically provide a threaded rod passing through and connecting with two articles, a pressing lever fitting with a movable end of the threaded rod, and an adjusting knob engaging with the threaded rod. When the urging device is going to be adjusted, the user has to turn the adjusting knob with a hand to loosen the articles, and by means of the pressing lever and the other hand of the user holds the articles, which intend to move, so that height thereof can be lifted or descended and the elevation angle thereof can be adjusted. As soon as the articles have been moved to a desired location, the adjusting knob is tightened such that the articles are located firmly. This kind of urging device has been utilized for years and even is applied in U.S. Pat. Nos. 5,257,767 and 5,924,666. However, the prior art has involved a common defect that both hands of the user have to be in use at the same time during the urging device being operated and this is troublesome and inconvenient.

SUMMARY OF THE INVENTION

An object of the present invention is to provide an axial urging mechanism, which has a support device, a connecting seat, a pivotal shaft, and a pressing device such that the connecting ends on the support device and the wing ends on the connecting seat can be tightened or released for adjusting with a single hand.

BRIEF DESCRIPTION OF THE DRAWINGS

The present invention can be more fully understood by referencing to the following detailed description and accompanying drawings, in which.

DETAILED DESCRIPTION OF THE PREFERRED EMBODIMENTS

Figure 1:
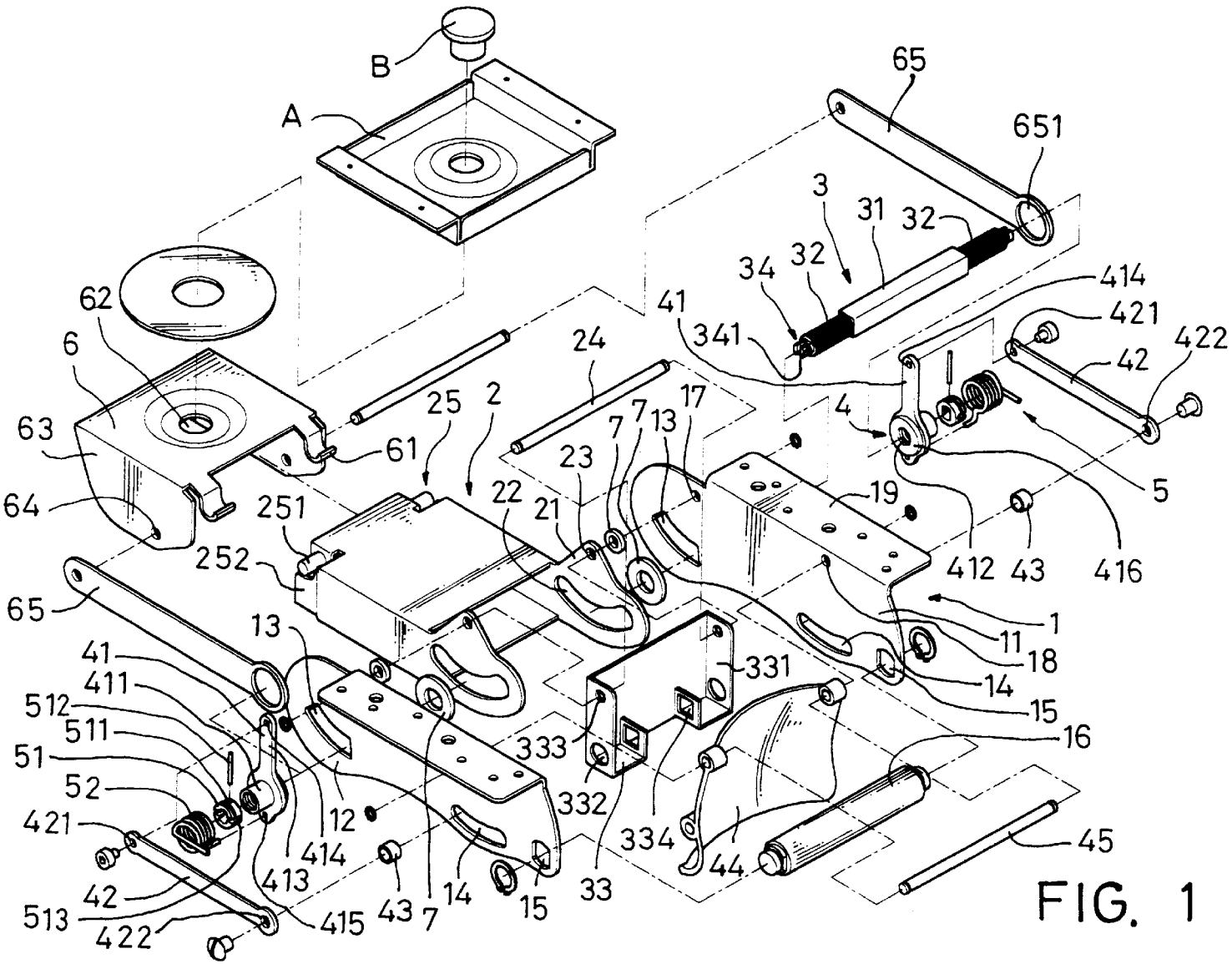
FIG. 1 is an exploded perspective view of an axial urging mechanism according to the present invention with related component parts.
Figure 2A:
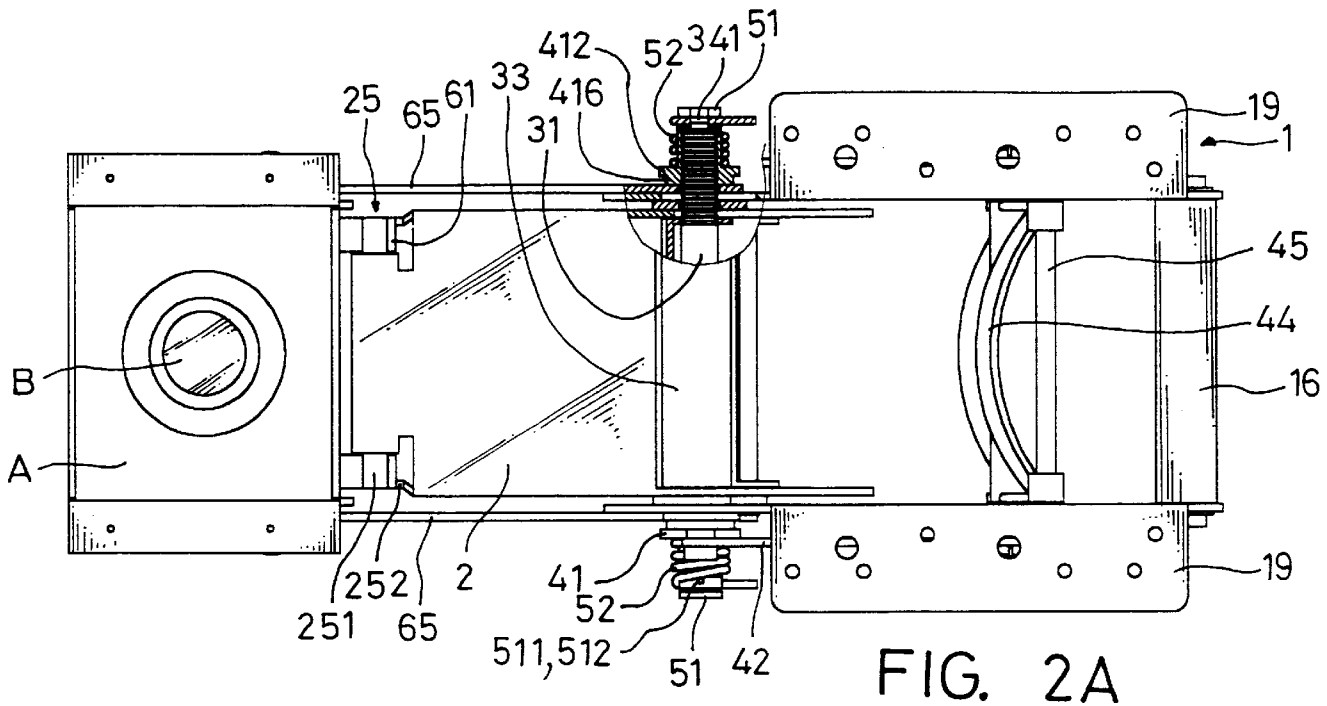
FIGS. 2A, 2B and 2C are a top view, a front view and a partial sectional view respectively after the parts shown in FIG. 1 are assembled.
Figure 2B:
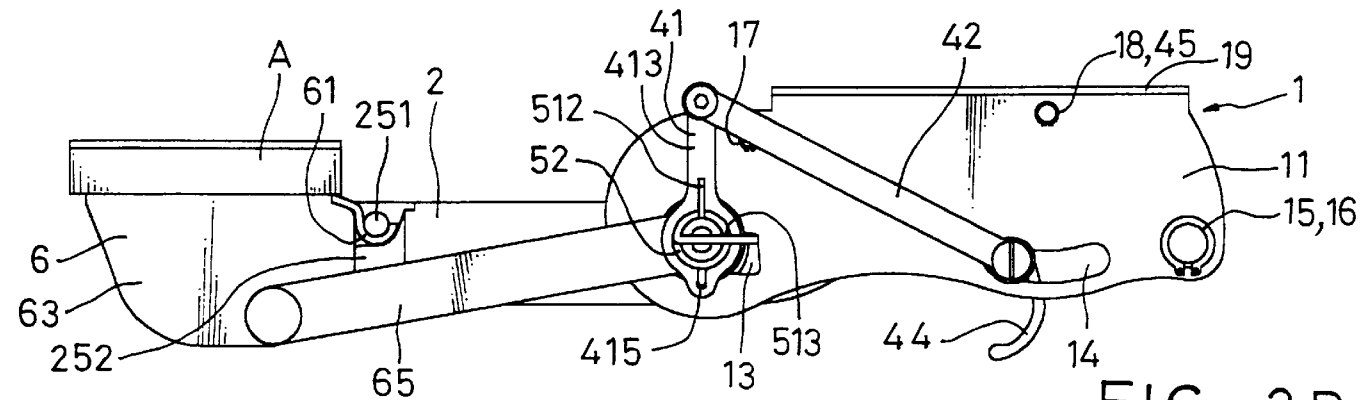
Figure 3C:
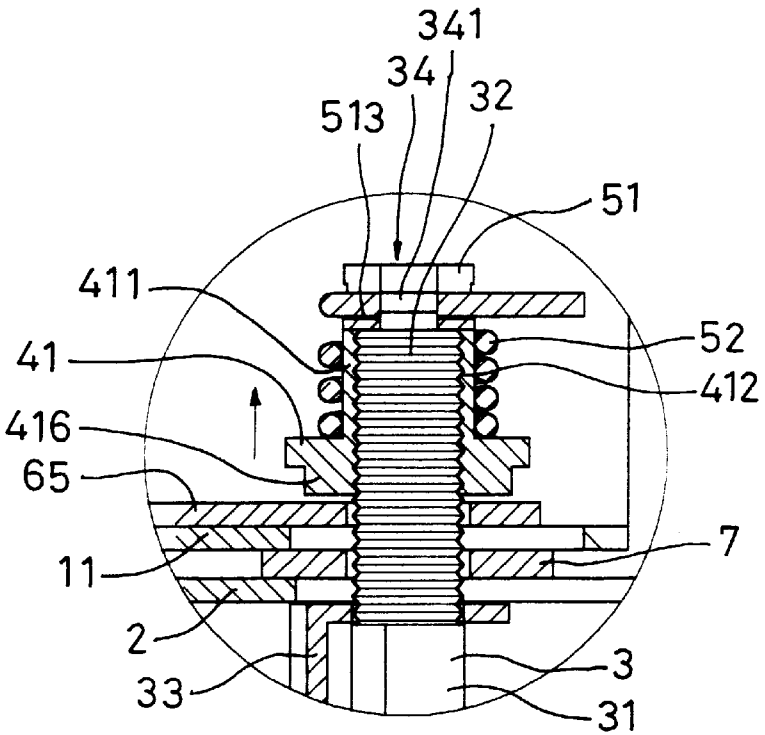
FIGS. 3A, 3B and 3C are a top view, a front view and a partial sectional view similar to FIGS. 2A, 2B and 2C respectively to illustrate the axial urging mechanism in operation.
Figure 2C:
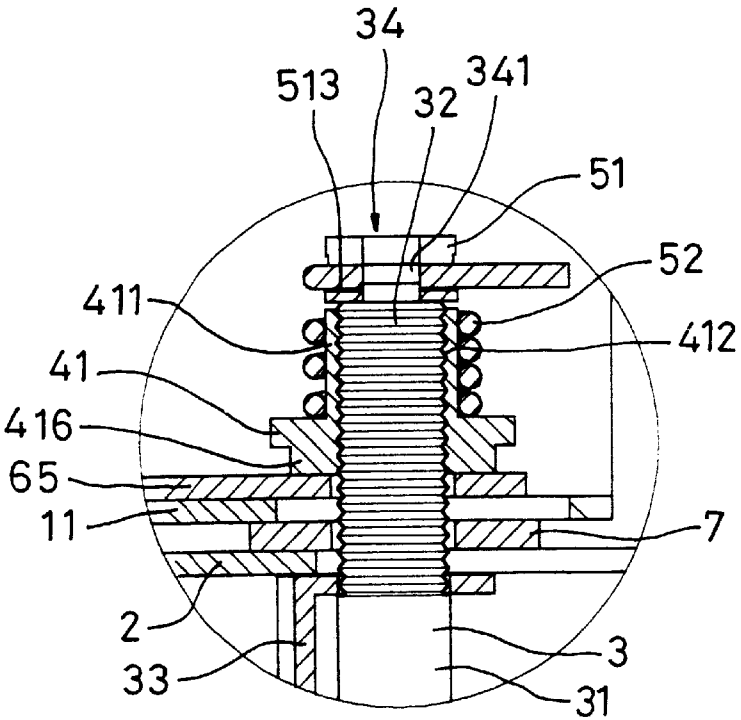
Figure 3A:
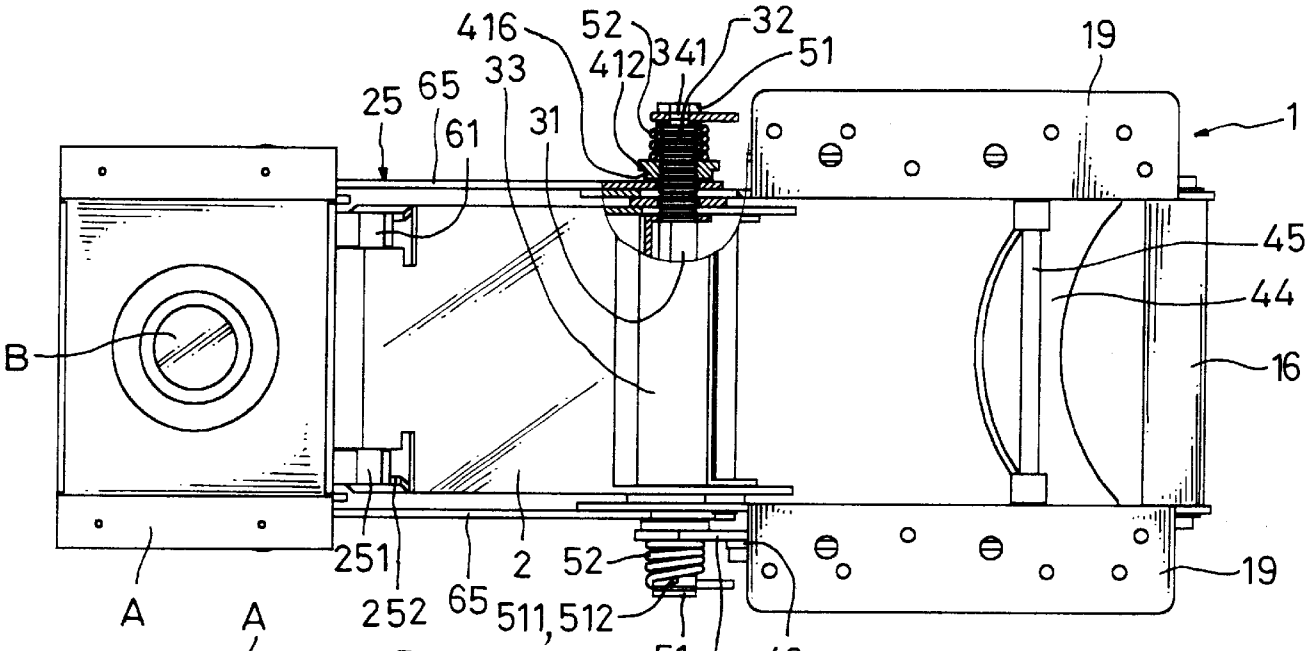
Figure 3B:
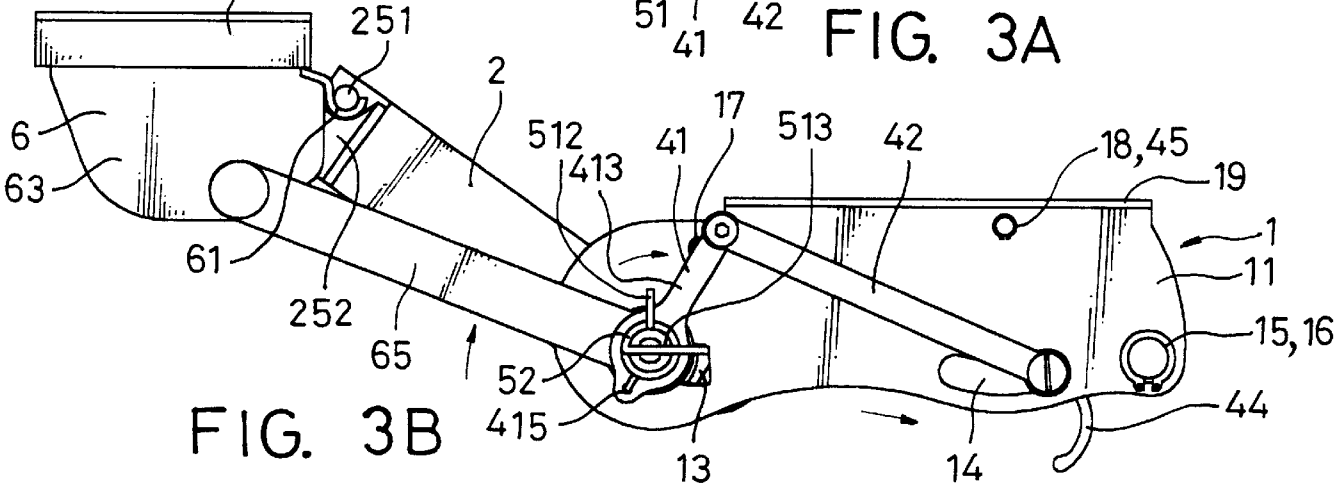
Figure 4:
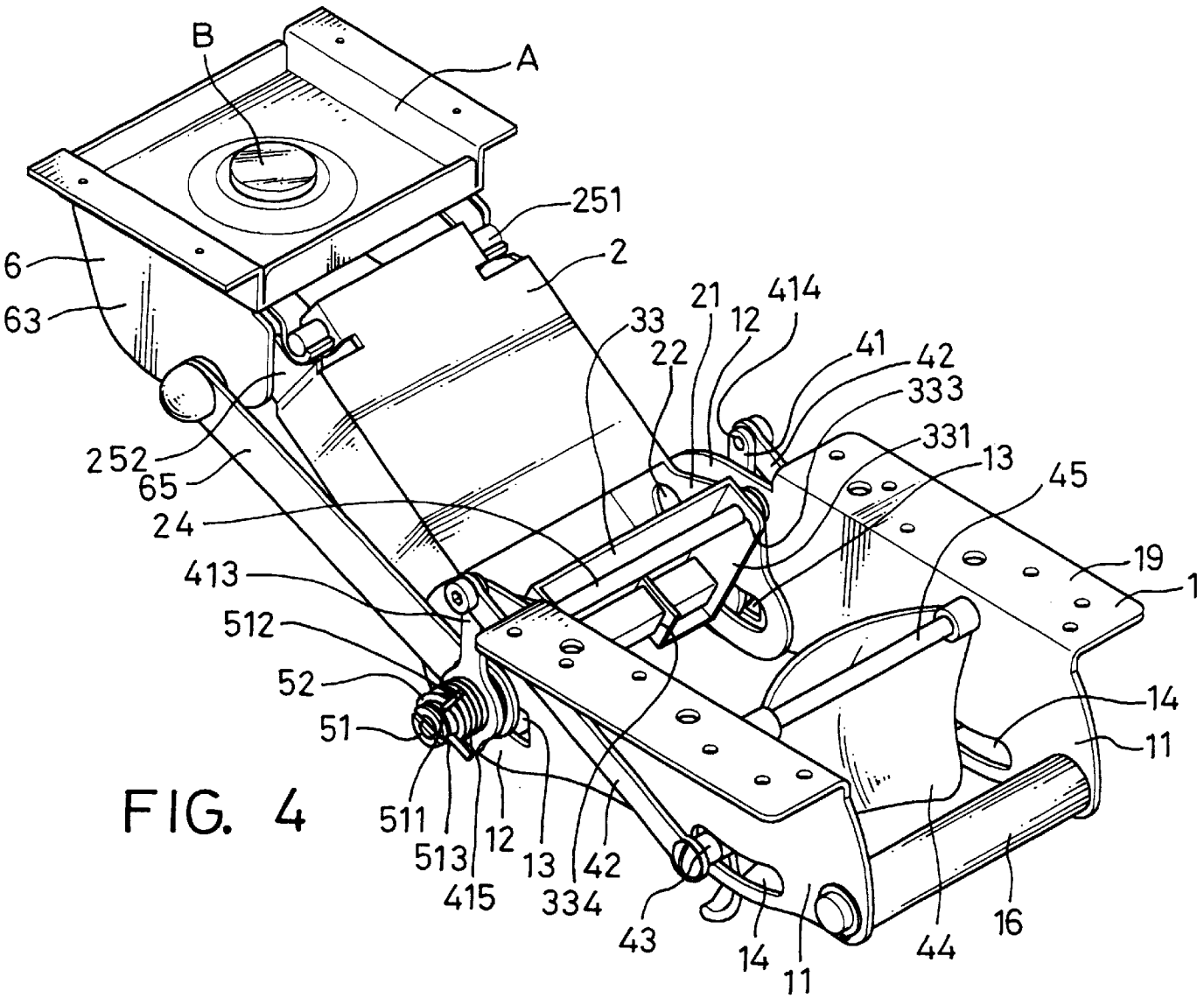
FIG. 4 is a perspective view of an axial urging mechanism according to the present invention.

Referring to FIGS. 1 to 4, an axial urging mechanism according to the present invention basically comprises a support device 1, a connecting seat 2, a pivotal shaft 3 and a pressing device 4.

Wherein, the support device 1 at each lateral side thereof includes a lateral wall 11, each lateral wall 11 at a connecting end 12 thereof has a slide groove 13 for being passed through by the pivot shaft 3. Another end opposite to the connecting end 12 on the respective lateral wall 11 has a guide groove 14 and an engaging hole 15 respectively so that the pressing device 4 can displace along the guide groove 14 and a handle bar 16 at both ends thereof can fixedly join with the engaging hole 15. An axial aperture 17 and a joining hole 18 are provided at the upper portion of the respective lateral wall 11. Details of the axial aperture 17 and the joining hole 18 will be disclosed afterward with other related component parts. Furthermore, the respective lateral wall 11 at the top thereof has an outwardly extending bearing plate 19 for connecting with an article such as a keyboard such that the support device can perform a function of support.

The connecting seat 2 is located next to the support device 1 and has a wing end 21 from each of two lateral sides thereof respectively so that the wing ends 21 are disposed between the two connecting ends 12 and includes an end groove 22 and an end hole 23 corresponding to the slide groove 13 and the axial aperture 17 respectively. Hence, the pivotal shaft 3 is arranged to pass through the end grooves 22 and the slide grooves 13 and a slender shaft 24 can pass through the end holes 23 and the axial apertures 17 such that the connecting seat 2 is movably joined with the support device 1. Moreover, another end of the connecting seat 2 provides a linking device 25 to connect with a rotary frame 6 via an engaging pin. Alternatively, the linking device 25 is composed of two horizontal connecting shafts 251 opposite to each other and two perpendicular arched plates 252 next to the connecting shafts 251. The rotary frame 6 at an end thereof provides a hook 61 adjacent to both lateral sides thereof respectively to engage with the two connecting shafts 251 and the respective hook 61 at the bottom of the outer surface thereof can rotate along the arched plates 252 so that the rotary frame 6 may be kept upright when the connecting seat 2 is in motion.

The pivotal shaft 3 at both ends thereof passes through the end groove 22 of the respective wind end 21 and the slide groove 13 of the respective connecting end 12 to provide a pivotal connection. The difference of the pivotal shaft 3 from the conventional art is that each end of the pivotal shaft 3 has a screw thread section 32 respectively and the screw thread sections 32 has two screw directions, wherein one is positive sense and the other one is reversed sense. In addition, the pivotal shaft 3 at the middle lever portion 31 thereof between the screw thread sections 32 adjacent to an inner wall surface of the respective wing end 21 provides a limit device 33 to prevent the wing ends 21 from shrinkage deformation caused by an axial urging force of the pressing device 4 such that the stability can be secured during such urging. As shown in FIGS. 1 to 4, the limit device 33 is disposed between the two wing ends 21 and provides respective holding plates 331 adjoining the respective wing end 21. The respective holding plate 331 provides a pivot hole 332 and a shaft hole 333 aligned with the end groove 22 and the end hole 23 on the respective wing end 21 so as to be passed through by the pivotal shaft 3 and the slender shaft 24. The respective holding plate 331 at the lower end thereof has an angle part bent inwardly and an angle hole 334 aligned with the respective pivot hole 332 such that the middle lever portion 31 of the pivot 3 can pass through the angle hole 334 of the respective holding plate 331 to move the limit device 4. Further, a washer 7 can be added to the pivotal shaft 3 between the respective slide groove 13 and the respective end groove 22 and can be added to the slender shaft 24 between the respective axial aperture 17 and the respective end hole 23 respectively to avoid a direct friction between the support device 1 and the connecting seat 2.

The pressing device 4 is composed of two follower levers 41 and two connecting rods 42, the respective follower lever 41 at the lower end thereof having a lever base 411. The lever base has a threaded hole 412 with a positive sense and a reversed sense of internal screws to engage with the respective screw thread sections 32 such that the inner wall surface of the respective follower lever 41 is in touch with the wall surface surrounding the slide groove 13. The respective follower lever 41 has an extending lever part 413 with a connecting hole 414 at the upper end thereof to connect with a movable end of the respective connecting rod by means of a locating pin. The respective connecting rod 42 at another end thereof has a fitting hole 422 to be attached with a bearing bush 43 and the bearing bush 43 keeps contact with the respective guide groove 14 while the respective connecting rod is in a state of moving.

Accordingly, the respective lower base 411 at the threaded hole 412 thereof may displace outwardly along the respective threaded section 32 at both ends of the pivotal shaft 3 to loosen the pressing force against the respective connecting end 12 as soon as a user holds the handle bar 16 with a hand by way of the thumb and the part between the thumb and the index finger thereof together with the rest four fingers pulling the bearing bush 43 forward along the guide groove 14 so as to resulting in the two connecting rods 42 moving forward with the two follower levers 41 rotating synchronously. Hence, the connecting seat 2 can move about the axis of the connecting seat 2 and allow the two wing ends 21 to perform an angular movement due to the end groove 22 being contact with the pivotal shaft 3 while the connecting seat 2 is in motion to adjust the support device 1 upwardly or downwardly. As soon as the adjustment has been performed, the bearing bush 43 is moved backward to result in the connecting rods 42 moving the follower levers 41. That is, the threaded holes 412 in the lower bases 411 engaging with the respective screw thread sections 32 such that the two connecting ends 12 and the two wing ends 21 between the follower levers 41 and limit device 33 are urged to fasten the support device 1.

Besides, in order to make it easier for the user during the operation of adjustment, the bearing bush 43 is connected to a stir plate 44 and a second slender shaft 45 at both ends thereof passes through the top of the stir plate 44 and fits with the two joining holes 18 respectively.

Furthermore, the two follower levers 41 include an automatic restoring device 5 respectively to perform the automatic urging job. The respective restoring device 5 has an end cap 51 to fit with a shaft end part 34 next to the respective screw thread section 32 on the pivot shaft 3 and has a spring 52 at an end thereof being fixedly attached to the respective follower lever 41 and at the other end thereof being fixedly attached to the end cap 51. Thus, the respective follower lever 41 is able to move back to the original position thereof automatically because of the restoring force of the spring 52 so as to be in a state of locking automatically. Wherein, the respective shaft end part 34 at the middle section thereof has a neck part 341 engaging the end cap 51, and a locating pin 512 passing through a lock hole 511 in the end cap 51 and received in the neck part 341 to affix the end cap 51 to the axial end part 34. A locating recess 513 is provided in front of the end cap 51 for fixing an end of the spring 52 and the other end of the spring 52 is inserted into a fitting hole 415 at the lower end of the follower lever 41.

As it has been mentioned previously, the connecting seat 2 at an end thereof has a connecting device 25 to connect with a rotary frame 6 in case of the present invention being used as a keyboard stand. The rotary frame 6 at the top thereof has a central engaging hole 62 and at two lateral wings thereof provides a locating hole 64 respectively. A connecting lever 65 at an end thereof connects with the respective locating hole 64 and at the other end thereof is an eye end 651 to fit with a projecting ring 416 at the inner side of the respective follower lever 41 to define the distance of movement between the rotary frame 6 and the support device 1 while the support device 1 is adjusted to go up or down and provide an elevation angle. In addition, the rotary frame 6 movably engages with the fixed plate A, which has been displaced in U.S. Pat. No. 5,881,984, by way of the central engaging hole 62 being riveted with a spindle B such that the rotary frame 6 can be turned to the right and to the left relative to the fixed plate A.

Hence, it is appreciated that the present invention can be operated by one hand to control the pressing device so that two opposite linking levers thereof can tighten or loosen the support device and the connecting seat disposed between the linking levers so as to adjust the support device up or down and the angle of elevation thereof relative to the connecting seat. By contrast with the known art, the present invention can be operated much more easily and can be located more reliably. Moreover, due to the automatic restoring device, the present invention can be kept tightened. In addition, the present invention can be arranged to be associated with a rotary frame and a fixed plate so as to constitute a keyboard stand with a function of being adjusted in a way of an omni-bearing.

While the invention has been described with reference to a preferred embodiment thereof, it is to be understood that modifications or variations may be easily made without departing from the spirit of this invention, which is defined by the appended claims.

What is claimed is:

1. An axial urging mechanism, comprising:

a support device including two opposite lateral walls, each having a connecting end;

a connecting seat with two opposite wing ends disposed between and adjacent to said connecting ends;

a pivotal shaft with two end parts, passing through the connecting ends and the wing ends, the two end parts having oppositely threaded screw sections;

a limit device at inner wall surfaces of the wing ends;

a pressing device including two follower levers, each of the follower levers having a lever base with a thread screw hole engaging one of the threaded screw sections of the pivotal shaft, inner wall surfaces of the follower levers being attached to the connecting ends of the support device, a lever part extending upwardly from the lever base connected with first ends of connecting rods and second ends of the connecting rods connecting with bearing bushes movably mounted to the support device;

whereby, movement of the bearing bushes causes the connecting rod to move the respective follower lever to actuate the pressing device such that the respective connecting ends and the respective wing end can be released for making an adjustment.

2. The axial urging mechanism according to claim 1, wherein the connecting ends on the support device have arched slide grooves and axial holes, and the wing ends have arched end grooves and end holes for being passed through by the pivotal shaft and a slender shaft respectively such that the support device can be adjusted up, down or an elevation angle adjusted with respect to the connecting seat.

3. The axial urging mechanism according to claim 2, further comprising first washers on the pivotal shaft between the slide groove and the end groove, and second washers on the slender shaft between the respective axial hole and the respective end hole.

4. The axial urging mechanism according to claim 1, further comprising guide grooves on the respective lateral walls of the support device movably engaged by the bearing bushes.

5. The axial urging mechanism according to claim 1, further comprising a stir plate connected to the bearing bushes and to a second slender shaft at a top thereof to connect with the lateral walls of the support device such that movement of the stir plate causes movement of the pressing device.

6. The axial urging mechanism according to claim 1, further comprising a handle bar connected with the lateral walls on the support device and disposed behind the bearing bushes.

7. The axial urging mechanism according to claim 1, wherein the limit device includes a holding plate disposed between and pressingly touching the two wing ends, and having pivot holes and shaft holes to accommodate the pivotal shaft and the slender shaft.

8. The axial urging mechanism according to claim 7, wherein the holding plate at a lower end thereof has angle parts being bent inwardly and including angle holes corresponding to pivot holes, such that a middle lever portion of the pivotal shaft passes through the angle holes.

9. The axial urging mechanism according to claim 1, comprising two automatic restoring devices, each restoring device having an end cap fitting with a shaft end part on the pivotal shaft adjacent to the screw sections and including a spring with a first end thereof fixedly attached to the follower lever and a second end thereof fixedly attached to the end cap so that the respective follower lever is automatically urge to an original position.

10. The axial urging mechanism according to claim 9, wherein the respective shaft end part includes a neck part and the end cap has a lock hole such that a locating pin passes through the lock hole to locate the end cap at the neck part, and a locating recess is provided on the end cap in which is inserted the second end of the spring.

11. The axial urging mechanism according to claim 1, wherein the lateral walls of the support device at a top thereof includes an outwardly extending bearing plate for connecting with an article.

12. The axial urging mechanism according to claim 1, wherein the connecting seat includes a connecting device connected with a rotary frame, the rotary frame at a top thereof connecting with a fixed plate such that the rotary frame can be turned and the rotary frame at two lateral wings thereof connects with a first end of a connecting lever, a second end of the connecting lever having an eye fitting with a projecting ring at an inner side of the associated follower lever.

13. The axial urging mechanism according to claim 12, wherein the connecting device comprises hooks at lateral sides of the rotary frame engaging connecting shafts on lateral sides of the connecting seat, and wherein an arched plate is disposed under the respective connecting shaft to support the respective hook.

* * * * *